United States Patent [19]

Alman

[11] Patent Number: 5,047,740

[45] Date of Patent: Sep. 10, 1991

[54] MICROWAVE SWITCH

[75] Inventor: Robert E. Alman, San Jose, Calif.

[73] Assignee: Hewlett-Packard Company, Palo Alto, Calif.

[21] Appl. No.: 536,813

[22] Filed: Jun. 12, 1990

[51] Int. Cl.[5] ..... H01H 53/00

[52] U.S. Cl. ..... 335/4; 335/5; 333/105

[58] Field of Search ..... 335/45; 333/105; 200/153 S

[56] References Cited

U.S. PATENT DOCUMENTS

| | | | |
|---|---|---|---|
| 3,131,268 | 4/1964 | Orner | 335/5 |
| 3,439,298 | 4/1969 | Steinback | 335/5 |
| 4,298,847 | 11/1987 | Hoffman | 333/105 |
| 4,965,542 | 10/1990 | Nelson | 335/4 |
| 4,967,174 | 10/1990 | Yee et al. | 335/4 |

*Primary Examiner*—Leo P. Picard
*Assistant Examiner*—Lincoln Donovan

[57] ABSTRACT

A mechanical switch for switching microwave signals and the like from one coaxial-type connector to another includes a housing to which are mounted three coaxial-type connectors with their inward ends located adjacent first and second jumpers. The first jumper is supported at one end of a first slider which is movable between a closed position at which two connector ends are electrically connected by the first jumper and an isolated position at which the two connector ends are not electrically connected by the first jumper. The second jumper is supported at one end of a second slider which is movable between a closed position at which two others of the connector ends are electrically connected by the second jumper and an isolated position at which the two other connector ends are not electrically connected together by the second jumper. A spring moves the second slider to its isolated position when the first slider is moved to its closed position and visa versa. An armature member is pivotally supported about a pivot axis, and a magnetic drive means rotates the armature about its pivot axis such that the first end of the armature drives the first slider into its closed position when the armature is rotated in one direction and the second end of the armature drives the second slider into its closed position when the armature is rotated in an opposite direction.

24 Claims, 4 Drawing Sheets

MICROWAVE SWITCH

BACKGROUND OF THE INVENTION

1. Field of the Invention

The present invention relates to mechanical switches and, more particularly, to switches for use in microwave applications.

2. State of the Art

In the field of microwave switching (i.e., wherein microwave signals are selectively switched from a first coaxial conductor to either a second or third coaxial conductor) mechanical switches are well known. In comparison to diode switches, however, mechanical switches are often considered to have inferior reliability with respect to repeatability over a large number of switching cycles (e.g., five million switching cycles).

Further in comparison to diode switches, microwave switches of the mechanical type incorporate moving parts that can wear and degrade performance. Accordingly, there exists a need in the art for a mechanical switch which does not exhibit noticeable performance degradation due to wear of moving parts over a large number of switching cycles (e.g., five million switching cycles).

Problems with conventional mechanical switches include: (1) compromises in performance due to part dimensions and spring properties, (2) high sensitivity in switching performance due to changes in magnetic properties and due to the relative orientation of the magnet and armature, (3) production of impact debris due to the armature striking the solenoid pole faces, (4) changes in effective area of the gap between the armature and core face as the core face is deformed by successive impacts with the armature, (5) the need for an adjustment mechanism to compensate for changes in magnetic properties, (6) wear in bearing areas of a slider mechanism due to torque produced by asymmetric leaf springs, (7) repeatability in jumper positioning in the ON and OFF states, (8) debris caused by repeated striking of the jumpers against mode suppressors which are used to absorb unwanted energy when the jumpers are in the OFF state, (9) breakage of the jumpers due to fatigue from repeated impact with the microwave cavity wall, and (10) less than optimum isolation due to the presence of a wide gap between the jumpers and the microwave cavity wall when the jumpers are in the OFF state. Accordingly, there exists a need in the art for a mechanical switch which overcomes the aforesaid problems.

SUMMARY OF THE INVENTION

Generally speaking, the present invention provides a mechanical switch for switching microwave signals and the like from one coaxial-type connector to another. In one preferred embodiment, a switch according to the invention includes a housing to which are mounted three coaxial-type connectors such that the inward ends of the connectors are located adjacent first and second jumpers. The first jumper is supported at one end of a first slider which is movable between a closed position at which two connector ends are electrically connected by the first jumper and an isolated position at which the two connector ends are not electrically connected by the first jumper. The second jumper is supported at one end of a second slider which is movable between a closed position at which two others of the connector ends are electrically connected by the second jumper and an isolated position at which the two other connector ends are not electrically connected together by the second jumper. A spring moves the second slider to its isolated position when the first slider is moved to its closed position and visa versa. An armature member is pivotally supported about a pivot axis such that the first end of the armature drives the first slider into its closed position and a second end of the armature drives the second slider into its closed. A magnetic drive means rotates the armature about the pivot axis such that the first end of the armature drives the first slider into its closed position when the armature is rotated in one direction and the second end of the armature drives the second slider into its closed position when the armature is rotated in an opposite direction. Preferably, the magnetic drive means includes a first solenoid coil adjacent the first end of the armature, a second solenoid coil adjacent the second end of the armature, a permanent magnet located between the first and second solenoid coils, and power supply means for activating the solenoid coils.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENTS

Figure 1:
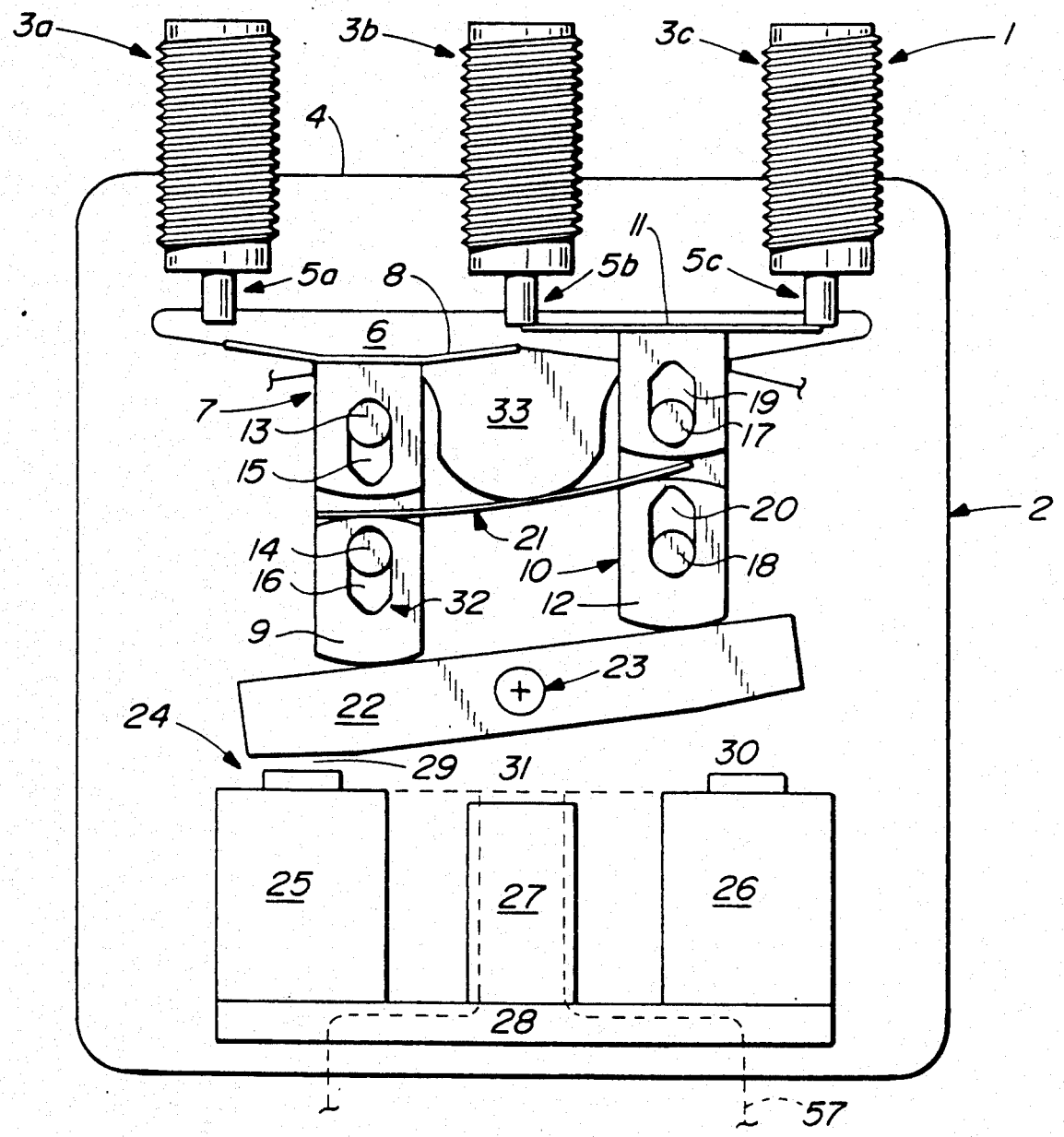
FIG. 1 is a top plan view of a mechanical switch according to the present invention.

In FIG. 1, a switch 1 includes a housing 2 to which are mounted three coaxial-type connectors 3*a*, 3*b*, and 3*c*, respectively. More particularly, the connectors are fixed to the sidewall of the housing such that the inward ends 5*a*, 5*b* and 5*c* of the respective ones of the connectors 3 are located in an open space 6 within the housing. The purpose of switch 1 is to allow a signal, such as a microwave signal, to be transmitted from the central connector 3*b* to either one of the other two connectors 3*a* or 3*c*.

Switching between the connectors is accomplished by jumper assemblies 7 and 10 comprising jumpers that are made of an electrically conducting material and sliders that are made of an electrically insulating material. For example, jumper assembly 7 includes a jumper member 8 supported at the end of a slider 9 such that the jumper is moveable between a closed position, at which connectors 3*a* and 3*b* are electrically connected by the jumper, and an isolated position at which the connectors are open circuited or "isolated" from one another. Similarly, jumper assembly 10 includes a jumper member 11 supported at the end of a slider 9 such that the jumper is moveable between a closed position, at which connectors 3*b* and 3*c* are electrically connected by the jumper, and an isolated position at which the connectors are open circuited.

In the illustrated embodiment, the sliders are each guided in the longitudinal direction by a pair of dowel pins. In the illustrated embodiment, for example, slider 9 is guided by dowel pins 13 and 14 which are received in slots 15 and 16, respectively. Similarly, slider 12 is guided by dowel pins 17 and 18 which are received in slots 19 and 20, respectively. Further in the illustrated embodiment, a return spring 21 extends between and engages the sliders 9 and 12 so that one of the sliders is moved to its isolated position whenever the other slider is moved to its closed position.

An armature 22 pivots about a pivot axis 23 located between opposite ends of the armature to drive the jumper assemblies into their isolated and closed positions. The armature is driven such that rotation of the armature in one direction about its pivot axis drives one jumper assembly into its closed position, while rotation of the armature in the opposite direction drives the other jumper assembly into its closed position.

In the illustrated embodiment, the means for driving armature 22 includes a first solenoid coil adjacent one end of the armature, a second solenoid coil 26 adjacent the other end of the armature, a permanent magnet 27 located between the solenoid coils and a steel plate 28 connecting the solenoid coils and permanent magnet such that they are between the steel plate 28 and the armature. A power supply means 57 is provided to activate the solenoid coils and the permanent magnet 27 can be arranged such that the North pole thereof faces the armature 22. Accordingly, one magnetic flux path extends between the magnet 27, the armature 22, the solenoid coil 25, the steel plate 28 and back to the magnet 27. Another magnetic flux path extends between the permanent magnet 27, the armature 22, the solenoid coil 26, the steel plate 28 and back to the magnet 27.

As shown in FIG. 1, armature 22 does not contact either of the solenoid coils or the permanent magnet since rotation of the armature is limited by the jumper assemblies. Accordingly, a first gap 29 is provided between the armature 22 and the solenoid coil 25, a second gap 30 is provided between the armature 22 and the solenoid coil 26, and a relatively large gap 31 is provided between the permanent magnet 27 and the armature 22. In operation, current is supplied by a power supply means 57 to one of the solenoid coils, the force of the permanent magnet in one of the magnetic flux paths is reduced. This allows the armature to rotate due to the greater force in the other magnetic flux path.

In practice, it is important that the positioning of the jumpers on the connector ends is very accurate and repeatable. As shown in FIG. 1, the slots in the sliders include V-shaped ends 32 formed by angled surfaces which are parallel to the pivot axis 23. In particular, as shown in FIG. 5*b*, the angled surfaces can be rectilinear and the planes in which the rectilinear surfaces lie meet at an apex A located along the longitudinal center line of the slots. The dowel pins are cylindrical with central axes thereof parallel to the pivot axis. Accordingly, when the dowel pins engage the V-shaped slot ends 32, the slider assemblies are very accurately aligned with respect to x, y and z axes such that the jumpers repeatedly contact the connector ends at the same position. Such repeatability in position is extremely important in microwave performance.

Figure 5A:
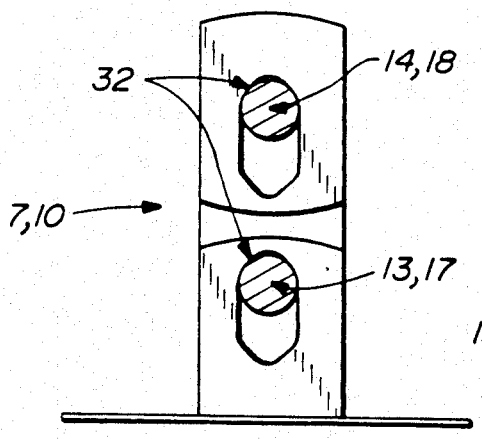
FIG. 5*a* is details of a dowel pin and slot arrangement for guiding the jumper assemblies according to the invention.
Figure 5B:
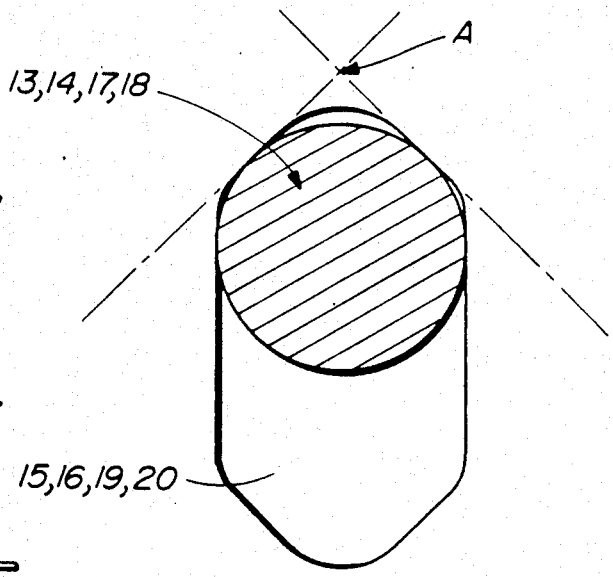
FIG. 5*b* is a detail view of the V-shaped ends of the slots shown in FIG. 5*a;*
Figure 7:
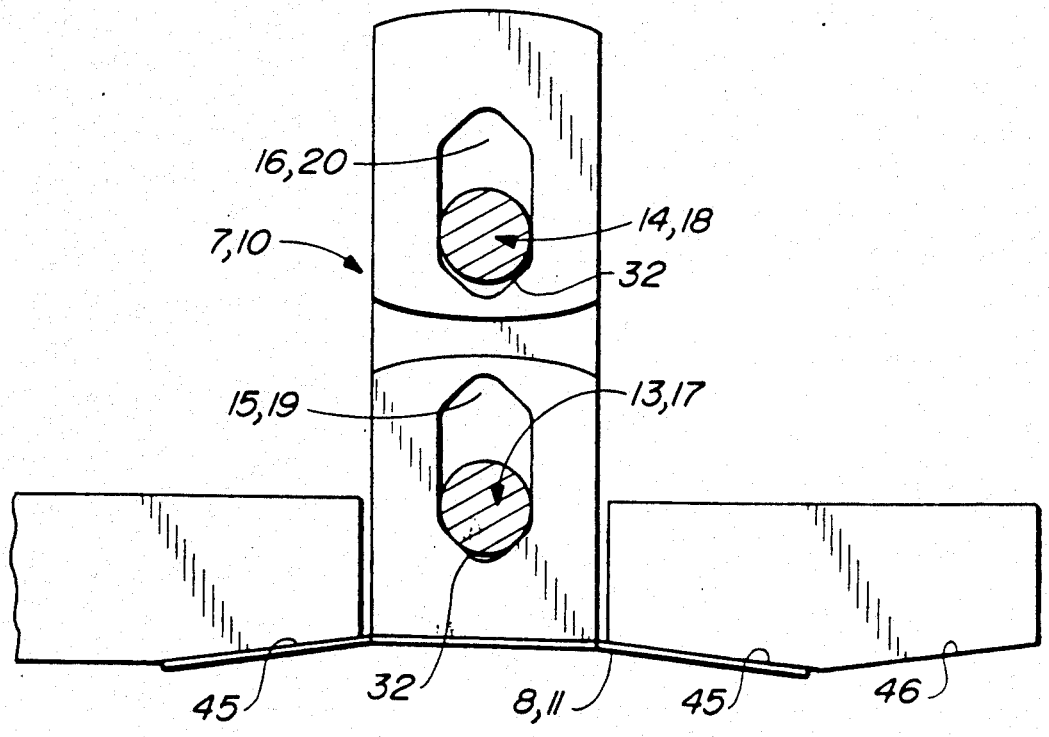
FIG. 7 is a detail view of the dowel pin and slot arrangement when the jumper assembly is in the isolated position according to the invention.

FIG. 5*a* shows how the two dowel pins engage the corresponding two V-shaped slot ends 32 when the slider assembly 7, 10 is moved to its closed position. In the isolated position, however, it is not necessary for both of the dowel pins to engage the V-shaped slot ends. Instead, as shown in FIG. 7, the dowel pin 13, 17 located closer to the jumper 8, 11 can be arranged so that it tightly engages the V-shaped end 32 of the slot 15, 19 whereas the other dowel pin 14, 18 can be arranged such that it loosely engages the V-shaped end 32 of the slot 16, 20 when the slider is in its isolated position. This allows limited rotation of the slider about the dowel pin 13, 17 to eliminate any gap between the jumpers 8, 11 and walls 45, 46 of the open space 6 which maximizes isolation in the case of microwave switching.

The illustrated embodiment promotes long switch life by preventing debris caused by sliding contact of parts. This also avoids loss of part tolerances and play between moving parts which would otherwise occur due to such wear thereby degrading microwave parameter repeatability. In particular, wear debris can be reduced by the reduction in moving parts and by providing rolling contact between contacting parts such as the spring 21 and the sliders, the sliders and the armature and the spring and a fulcrum member 33. Furthermore, by preventing gaps between the jumper and the housing wall when the slider is in its isolated position, isolation is not degraded due to the jumper projecting into the microwave cavity and mode suppressors (such as polyiron which causes debris due to repeated impact with the jumpers) are not needed behind the jumpers to absorb unwanted energy.

In practice, the jumpers can be thin (less than 0.003 inch thickness) and flexible which provides superior microwave properties compared to a straight rigid jumper. Furthermore, the flexible jumper can have a non-linear or bent configuration 47 (as shown by jumper 8 in FIG. 1) which provides a wiping action which clears small particle of debris from the contacts and extends the life of the switch. However, such flexible jumpers are not as strong as the rigid straight jumpers and could present a breakage problem due to fatigue if such flexible jumpers are repeatedly pulled against a wall of the housing when in the isolated position. However if the flexible jumpers are not pulled flat against a wall, they will resonate and degrade isolation performance. The isolated position of the jumper is very accurately controlled by the dowell pin located closest to the jumper and the looser fit between the dowel pin located further from the jumper allows the jumper to self align to the wall when the bend angles of the jumper and wall are not exactly matched.

Figure 6:
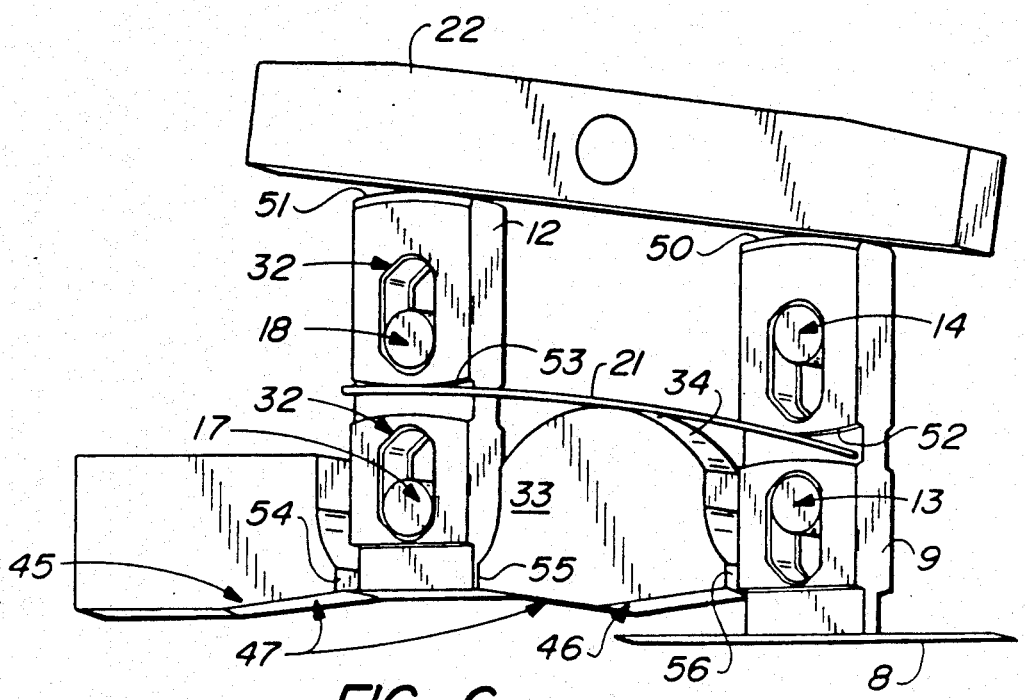
FIG. 6 (is a detail view of the isolated and closed positions of the jumper assemblies according to the invention.

As shown in FIG. 6, the fulcrum member 33 includes a fulcrum surface 34 which provides a variable fulcrum in rolling contact with the spring 21. As the sliders move in opposite directions due to movement of the armature 22, the point of contact between the spring 21 and the fulcrum surface 34 changes. As a result, the return force due to the spring 21 is at a maximum at the beginning of movement of the slider from its closed position and the return force becomes progressively more gentle as the slider reaches the isolated position. The spring force decreases in this manner because the point of contact between the spring and the fulcrum surface becomes further away from the slider as it moves towards its isolated position. The shape of the fulcrum surface can be varied to optimize this effect, that is, maximize the return force at the beginning of movement and minimize the return force as the jumper engages the microwave cavity wall of the open space 6.

Figure 2:
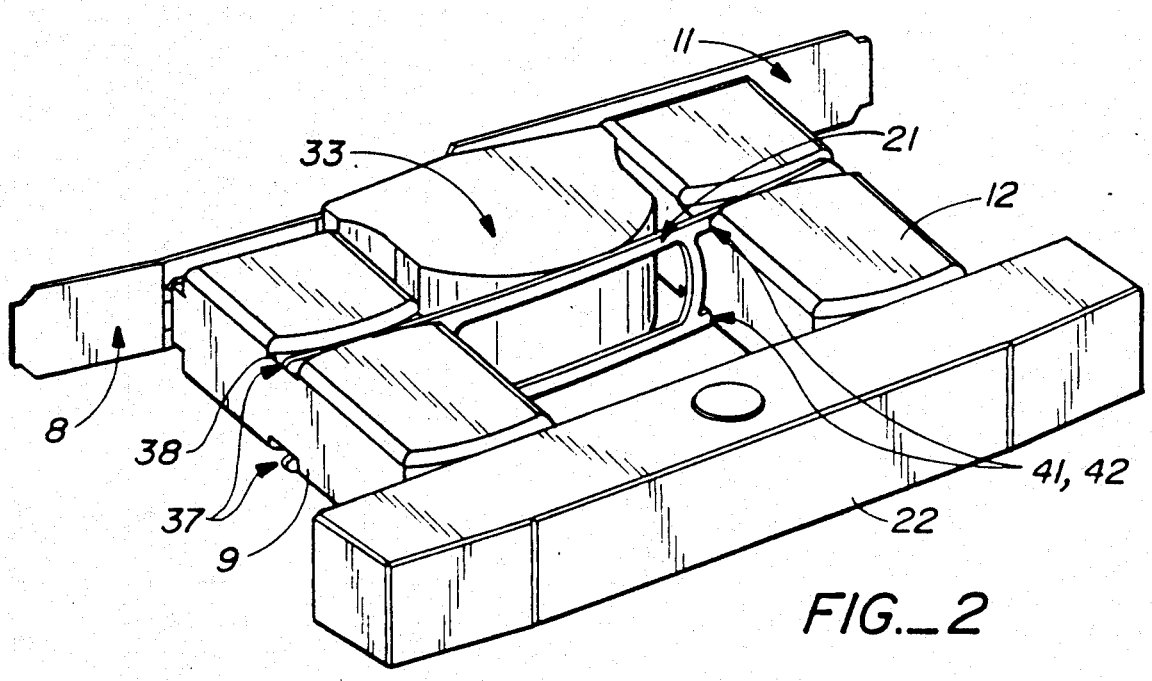
FIG. 2 shows four moving parts of the switch of FIG. 1.
Figure 3A:
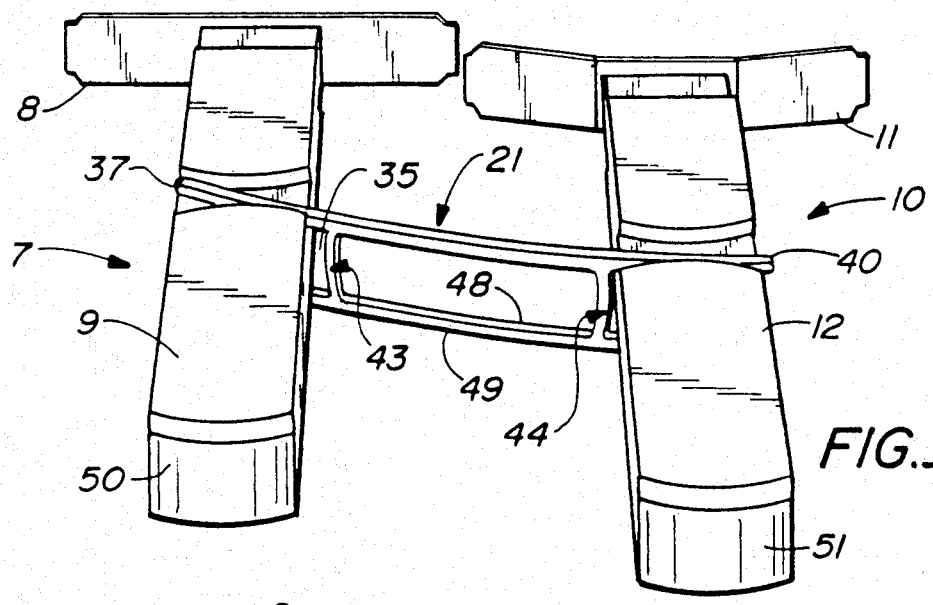
FIG. 3*a* is a perspective view of two jumper assemblies and a spring of FIG. 1.
Figure 3B:
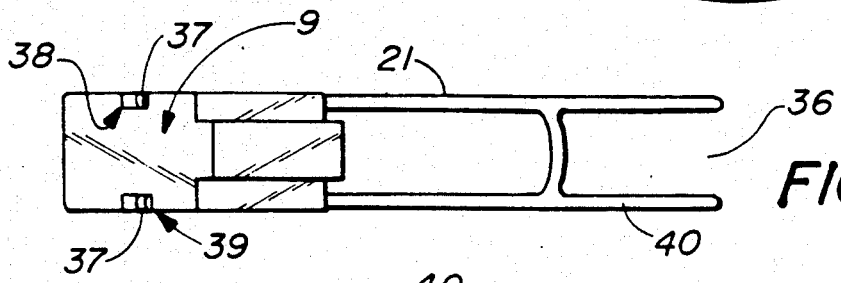
FIG. 3*b* is a perspective view of one of the jumper assemblies of FIG. 3*a;*
Figure 3C:
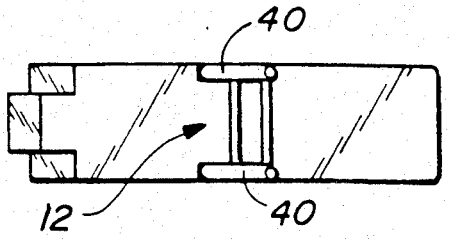
FIG. 3*c* is a perspective view of the other jumper assembly shown in FIG. 3*a;*

As shown in FIGS. 2 and 3, the spring 21 can be H-shaped. This provides balanced forces on both sides of each slider to prevent introduction of torque acting on the slider. In particular, a cut-out 35 extends into one end of the spring 21 between spaced-apart portions 37 of the spring. The slider 9 includes a first groove 38 on one side thereof and a second groove 39 on the opposite side thereof and the first portions 37 of the spring are received in the grooves 38, 39. Furthermore, surfaces 52 of the grooves 38, 39 which contact the spring 22 can be curved or have a convex shape to provide rolling contact between the spring and the slider.

In the same manner, the other end of the spring 21 includes a cut-out 36 between spaced-apart portions 40 of the spring. These portions 40 are received in grooves 41, 42 in the slider 12 with surfaces 53 thereof in contact with the spring. The grooves 41, 42 are identical in shape and function to the grooves 38, 39 of the slider 9. Thus, one surface 48 of the spring contacts the fulcrum surface 34 and the opposite surface 49 of the spring contacts the spring contact surfaces 52, 53 of the sliders.

To provide rolling engagement between the sliders and the armature 22, the slider 9 includes a curved or convex shaped surface 50 at an end thereof opposite to the end at which the jumper 8 is supported. Likewise, the slider 12 includes a curved surface 51 at the end thereof opposite to the end at which the jumper 11 is supported. As shown in FIGS. 2 and 6, the four moving parts, that is, the armature 22, the two sliders 9, 12 and the spring 21 are maintained in rolling contact with each other and debris due to wear is significantly avoided.

The spring 21 includes centering means for centering the spring between the sliders. The centering means comprises a first curved or convex shaped surface 43 facing the slider 9 and a second curved or convex shaped surface 44 facing the slider 12. The curved surfaces 43, 44 center the spring 21 when the sliders 9, 12 are midway between their closed and isolated positions.

The housing 2 can include guide members 54, 55, 56, and so forth slideably engaging opposite sides of the sliders at ends thereof adjacent the jumpers, as shown in FIG. 6.

At this juncture, it can be appreciated that the above-described mechanical switch has a number of significant advantages in terms of ease of construction, reliability and long life of the switch. These features are summarized as follows:

As shown in FIG. 1, a one piece steel armature can push directly on the sliders until the RF circuit is completed. With this arrangement, no spring coupling is used. Tolerances are compensated for by providing wide gaps between the armature and solenoid pole faces and between the armature and the magnet pole face. No impact debris is produced and, since there is a gap between the armature and solenoid pole face, recapture forces are minimized. The result is a simple, forgiving design which is easy to build, requires no adjustment, and performs over a wide operating range.

The large gaps at the armature and pole faces increases the operating voltage range because a surface of zero magnetic flux density will always exist between the armature and the solenoid core face when the solenoid is activated. This minimizes recapture forces which limit the operating range. No impact debris is created because the armature never contacts the solenoid core face. No coupling springs are needed to absorb dimensional tolerances since the tolerances are absorbed by the gap. Furthermore, switching performance is consistent because the pole face area does not change due to deformation and/or wear from the armature striking the solenoid pole face.

As shown in FIG. 2, a symmetric, floating leaf spring can be used to transfer a portion of the drive force to the isolated slider pulling it away from the RF circuit path. The leaf spring applies equal pressure to the top and bottom bearing surfaces of the sliders applying insignificant torque to the slider. As shown in FIG. 3, the spring is held in position by the slider and does not contact the housing except at the pivot point. The pivot point varies as the slider moves, changing the mechanical advantage which keeps the force on the drive mechanism to a minimum until the armature is at the end of its travel, where the drive force is maximum. The result is a mechanism which produces insignificant debris, while providing uniform forces.

With the balanced, floating return spring, even force is applied to the slider with zero torque. This produces far less wear debris in the bearing areas of the slider. The spring self-locates between sliders and conducting planes and the spring self-centers at midstroke where the load is essentially zero. Furthermore, the spring does not contact the housing except at the pivot point plus no wear debris is produced and no friction is produced. The variable pivot point for the return spring to rock on provides virtually no sliding motion of the spring against the housing thus producing negligible wear debris. The variable pivot changes the mechanical advantage of the spring as the switching motion takes place. That is, maximum spring force is achieved when the drive force is maximum and minimum spring force is achieved when the drive force is minimum. The shape of the pivot surface can be fine tuned to provide maximum performance.

Figure 4:
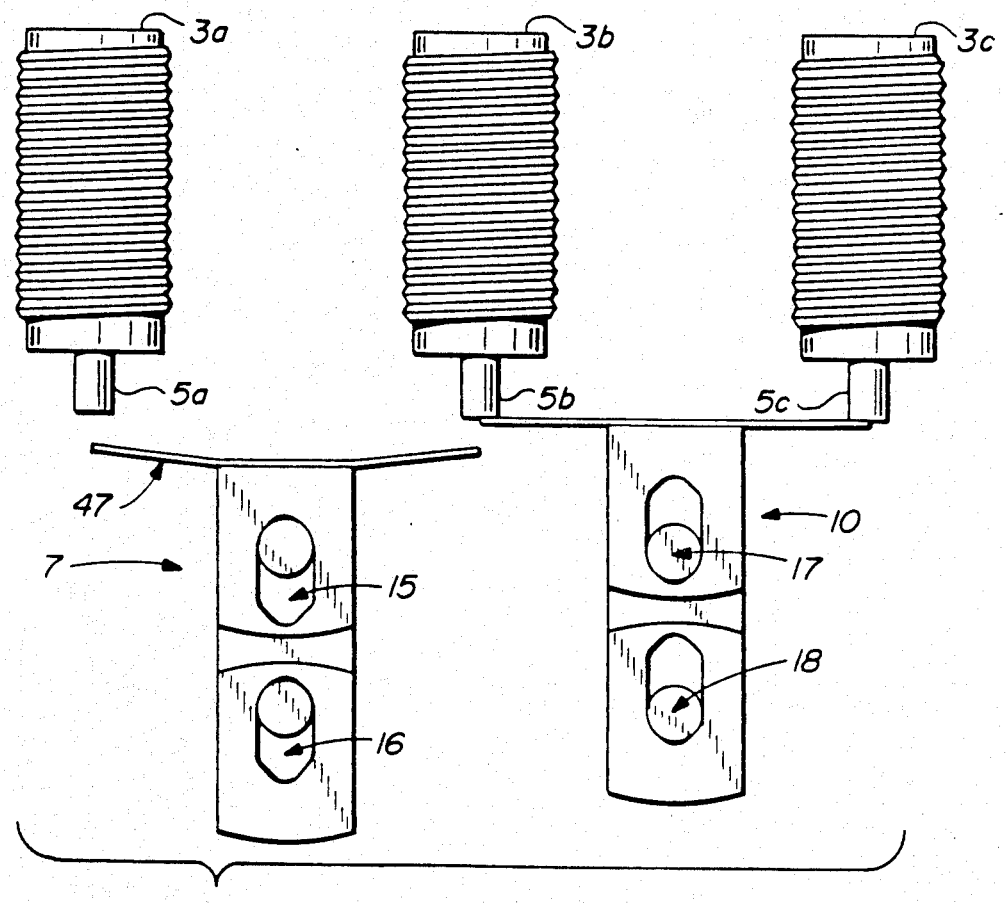
FIG. 4, is a first jumper assembly in an isolated position and a second jumper assembly in a closed position according to the invention.

As shown in FIG. 4, the jumper is positioned by means of the dowel pins which are slideably received in the slots of the slider. This allows the use of a thin flexible jumper which has better microwave performance than a rigid straight jumper. As shown in FIG. 5, the location of the slider is more accurately held in place by the use of angled ramps inside the slider slots (V-shaped slot ends) rather than cylindrical slots. Each of the two dowel pins interferes with the angled ramps, aligning the slider with the vertex of the ramps perpendicular to upper and lower conducting planes. The alignment occurs regardless of the dimensions of the parts and, therefore, is highly repeatable. As shown in FIG. 6, the slider interferes with both dowel pins in the forward position where the jumper is in the closed position. This allows substantial control of the positioning of the slider and jumper in the closed position.

To achieve high isolation in the isolated position, the jumper must be held as closely as possible to the wall opposite the connector tip adjacent to the slider. If the thin jumper is pulled too hard against this wall, it will break, so the position must be accurately controlled. The position of the walls is controlled by very close positioning of the walls in relation to the locating dowel pins. This reduces the location tolerance between the slider position and the walls. The jumper bend angle is formed to maximize the area of the jumper which comes in contact with the wall and, thereby, to minimize resonance of the jumper and to yield high port-to-port isolation. As shown in FIG. 7, to improve the contact further, the slider can be positioned using only the pin closest to the wall to allow the jumper to self align to the wall when the bend angles are not exactly identical.

The slotted sliders with angled ramps in slots locates the slider with respect to longitudinal, transverse and vertical axes using two dowel pins and both conducting planes. The angled ramps force the slider to be parallel to the conducting planes regardless of the individual part sizes. Positioning of the slider is thus very repeatable which directly improves microwave repeatability. Furthermore, positioning of the jumper requires no dielectric guide rods which produce failure inducing debris. The slider locates on both dowel pins in the forward (closed) position thus reducing rotation of the slider to a minimum. The position repeatability of the slider is thereby directly improved. Furthermore, high drive forces are spread out over the two pins thus increasing the life of the slider. The slider locates on only the forward dowel pin in the retracted (isolated) position. This allows the rear section of the slider to rotate to minimize the gap between the jumper and the housing wall to maximize isolation. The housing walls are positioned with respect to only one pin, so tighter position tolerances can be used to maximize isolation. The forward dowel pin is the closest to the housing walls so that only the shortest portion of the slider needs to be controlled. This will ensure that the smallest part to part variation due to slider shrinkage and thermal expansion will occur. The close position tolerances allows tight control of forces on the jumpers in the retracted position. This allows thin, flexible jumpers to be used while avoiding a wide gap behind the jumpers that would degrade isolation.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims. Thus, it should be appreciated that workers skilled in the art may make variations in the above-described embodiments without departing from the spirit and scope of present invention as defined by the following claims.

What is claimed is:

1. A mechanical switch comprising:

a housing;

electrical connectors mounted with their ends extending into the housing;

a first jumper supported at one end of a first slider, the first slider being movable between a closed position at which two connector ends are electrically connected by the first jumper and an isolated position at which the two connector ends are not electrically connected by the first jumper;

a second jumper supported at one end of a second slider, the second slider being movable between a closed position at which two others of the connector ends are electrically connected by the second jumper and an isolated position at which the two other connector ends are not electrically connected together by the second jumper;

spring means for moving the second slider to its isolated position when the first slider is moved to its closed position and for moving the first slider to its isolated position when the second slider is moved to its closed position;

an armature pivotally supported about a pivot axis such that the first end of the armature drives the first slider into its closed position and a second end of the armature drives the second slider into its closed position; and magnetic drive means for rotating the armature such that a first end of the armature drives the first slider into its closed position when the armature is rotated in one direction and a second end of the armature drives the second slider into its closed position when the armature is rotated in an opposite direction.

2. The switch of claim 1, wherein the magnetic drive means includes a first solenoid coil adjacent the first end of the armature, a second solenoid coil adjacent the second end of the armature, a permanent magnet located between the first and second solenoid coils, and power supply means for activating the solenoid coils, the first end of the armature being out of contact with and spaced from the first solenoid coil by a first gap when the second end of the armature drives the second slider into its closed position and the second end of the armature being out of contact with and spaced from the second solenoid coil by a second gap when the first end of the armature drives the first slider into its closed position.

3. The switch of claim 1, further comprising a first pair of spaced-apart dowel pins supported by the housing and slideably received in a first pair of slots in the first slider, the dowel pins engaging ends of the slots when the first slider is in its closed position and a second pair of spaced-apart dowel pins supported by the housing and slidable received in a second pair of slots in the second slider, the second pair of dowel pins engaging ends of the second pair of slots when the second slider is in its closed position.

4. The switch of claim 3, wherein the ends of the slots are V-shaped, each of the V-shaped ends being formed by angled surfaces which are parallel to the pivot axis.

5. The switch of claim 1, wherein the spring means includes a spring engaging the first and second sliders and a fulcrum member supported by the housing, the spring including first and second opposed surfaces, the fulcrum including a curved fulcrum surface in rolling contact with the first surface of the spring and the first and second sliders including curved spring contact surfaces in rolling contact with the second surface of the spring.

6. The switch of claim 1, wherein the spring means includes a spring engaging the sliders and variable fulcrum means for varying a spring force exerted by the spring on the sliders such that the sliders receive a maximum spring force when the sliders begin to move out of their closed positions and a progressively more gentle spring force as the sliders move into their isolated positions.

7. The switch of claim 1, wherein the spring means includes a leaf spring and a fulcrum member supported by the housing, the fulcrum member including a fulcrum surface engaging the spring, the spring having cut-outs at each end thereof in which the sliders are received, the spring including a pair of spaced-apart portions at each end defining the cut-outs, each of the sliders including grooves on opposite sides thereof in which the respective portions of the spring are received such that the spring contacts only the sliders and the fulcrum surface as the sliders move back and forth between their closed and isolated positions.

8. The switch of claim 1, wherein the spring means includes a spring and centering means for centering the spring between the sliders, the centering means comprising curved surfaces facing the sliders, the curved surfaces centering the spring when the first and second sliders are midway between their closed and isolated positions.

9. The switch of claim 1, wherein the jumpers are in a non-linear configuration when the sliders are in their isolated positions and in a linear configuration when the sliders are in their closed positions so as to provide a wiping action on the connector ends when the sliders are moved into and out of their closed positions, the housing including walls configured such that the jumpers lie flat against the walls when the first sliders are in their isolated positions.

10. A mechanical switch comprising:

a housing;

electrical connectors having connector ends thereof located within an open space defined by the housing;

a first jumper supported at one end of a first slider, the first slider being movable between a closed position at which a pair of the connector ends are electrically connected together by the first jumper and an isolated position at which the pair of connector ends are not electrically connected together by the first jumper;

a second jumper supported at one end of a second slider, the second slider being movable between a closed position at which a different pair of the connector ends are electrically connected together by the second jumper and an isolated position at which the different pair of connector ends are not electrically connected together by the second jumper;

first and second spaced-apart dowel pins supported by the housing and slideably received in first and second slots, respectively, in the first slider, the first and second dowel pins engaging respective ends of the first and second slots when the first slider is in its closed position;

third and fourth spaced-apart dowel pins supported by the housing and slidable received in third and fourth slots, respectively, in the second slider, the third and fourth dowel pins engaging respective ends of the third and fourth slots when the second slider is in its closed position;

a spring extending between and engaging the first and second sliders such that the second slider is moved to its isolated position when the first slider is moved to its closed position and the first slider is moved to its isolated position when the second slider is moved to its close position;

an armature pivotally supported about a pivot axis located intermediate first and second ends of the armature such that the first end of the armature is in rolling contact with and drives the first slider into its closed position and the second end of the armature is in rolling contact with and drives the second slider into its closed position; and magnetic drive means for magnetically rotating the armature about the pivot connection such that the first end of the armature drives the first slider into its closed position when the armature is rotated in one direction and the second end of the armature drives the second slider into its closed position when the armature is rotated in an opposite direction.

11. The switch of claim 10, wherein the first dowel pin is located closer to the first jumper than the second dowel pin, the first dowel pin tightly engaging an end of the first slot and the second dowel pin loosely engaging an end of the second slot when the first slider is in its isolated position to allow limited rotation of the first slider about the first dowel pin, the third dowel pin being located closer to the second jumper than the fourth dowel pin, the third dowel pin tightly engaging an end of the third slot and the fourth dowel pin loosely engaging an end of the fourth slot when the second slider is in its isolated position to allow limited rotation of the second slider about the third dowel pin.

12. The switch of claim 10, wherein the ends of the slots are V-shaped, each of the V-shaped ends being formed by angled surfaces which are parallel to the pivot axis.

13. The switch of claim 10, wherein the spring means includes a spring engaging the first and second sliders and a fulcrum member supported by the housing, the spring including first and second opposed surfaces, the fulcrum including a curved fulcrum surface in rolling contact with the first surface of the spring and the first and second sliders including curved spring contact surfaces in rolling contact with the second surface of the spring.

14. The switch of claim 10, wherein the spring means includes a spring engaging the sliders and variable fulcrum means for varying a spring force exerted by the spring on the sliders such that the sliders receive a maximum spring force when the sliders begin to move out of their closed positions and a progressively more gentle spring force as the sliders move into their isolated positions.

15. The switch of claim 10, wherein the spring means includes a leaf spring and a fulcrum member supported by the housing, the fulcrum member including a fulcrum surface engaging the spring, the spring having cut-outs at each end thereof in which the sliders are received, the spring including a pair of spaced-apart portions at each end defining the cut-outs, each of the sliders including grooves on opposite sides thereof in which the respective portions of the spring are received such that the spring contacts only the sliders and the fulcrum surface as the sliders move back and forth between their closed and isolated positions.

16. The switch of claim 10, wherein the spring means includes a spring and centering means for centering the spring between the sliders, the centering means comprising curved surfaces facing the sliders, the curved surfaces centering the spring when the first and second sliders are midway between their closed and isolated positions.

17. The switch of claim 10, wherein the jumpers are in a non-linear configuration when the sliders are in their isolated positions and in a linear configuration when the sliders are in their closed positions so as to provide a wiping action on the connector ends when the sliders are moved into and out of their closed positions, the housing including walls configured such that the jumpers lie flat against the walls when the first sliders are in their isolated positions.

18. A mechanical switch comprising:

a housing;

electrical connectors having connector ends thereof located within an open space defined by the housing;

a first jumper supported at one end of a first slider, the first slider being movable in a longitudinal direction between a closed position at which a pair of the connector ends are electrically connected together by the first jumper and an isolated position at which the pair of connector ends are not electrically connected together by the first jumper;

a second jumper supported at one end of a second slider, the second slider being movable in the longitudinal direction between a closed position at which a different pair of the connector ends are electrically connected together by the second jumper and an isolated position at which the different pair of connector ends are not electrically connected together by the second jumper;

first and second spaced-apart dowel pins supported by the housing and slideably received in first and second slots which extend in the longitudinal direction, respectively, in the first slider, the first and second dowel pins engaging respective longitudinal ends of the first and second slots when the first slider is in its closed position;

third and fourth spaced-apart dowel pins supported by the housing and slideably received in third and fourth slots which extend in the longitudinal direction, respectively, in the second slider, the third and fourth dowel pins engaging respective longitudinal ends of the third and fourth slots when the second slider is in its closed position;

spring means for moving the second slider to its isolated position when the first slider is moved to its closed position and for moving the first slider to its isolated position when the second slider is moved to its closed position;

an armature pivotally supported about a pivot axis located intermediate first and second ends of the armature, the first end of the armature driving the first slider into its closed position and the second end of the armature driving the second slider into its closed position;

magnetic drive means for magnetically rotating the armature about the pivot axis such that the first end of the armature drives the first slider into its closed position when the armature is rotated in one direction and the second end of the armature drives the second slider into its closed position when the armature is rotated in an opposite direction about the pivot axis; and each of the dowel pins being cylindrical with central axes thereof parallel to the pivot axis and each of the ends of slots being V-shaped and formed by a pair of angled surfaces which are parallel to the pivot axis.

19. The switch of claim 18, wherein the first dowel pin is located closer to the first jumper than the second dowel pin, the first dowel pin tightly engaging an end of the first slot and the second dowel pin loosely engaging an end of the second slot when the first slider is in its isolated position to allow limited rotation of the first slider about the first dowel pin, the third dowel pin being located closer to the second jumper than the fourth dowel pin, the third dowel pin tightly engaging an end of the third slot and the fourth dowel pin loosely engaging an end of the fourth slot when the second slider is in its isolated position to allow limited rotation of the second slider about the third dowel pin.

20. The switch of claim 18, wherein the spring means includes a spring engaging the first and second sliders and a fulcrum member supported by the housing, the spring including first and second opposed surfaces, the fulcrum including a curved fulcrum surface in rolling contact with the first surface of the spring and the first and second sliders including curved spring contact surfaces in rolling contact with the second surface of the spring.

21. The switch of claim 18, wherein the spring means includes a spring engaging the sliders and variable fulcrum means for varying a spring force exerted by the spring on the sliders such that the sliders receive a maximum spring force when the sliders begin to move out of their closed positions and a progressively more gentle spring force as the sliders move into their isolated positions.

22. The switch of claim 1, wherein the spring means includes a leaf spring and a fulcrum member supported by the housing, the fulcrum member including a fulcrum surface engaging the spring, the spring having cut-outs at each end thereof in which the sliders are received, the spring including a pair of spaced-apart portions at each end defining the cut-outs, each of the sliders including grooves on opposite sides thereof in which the respective portions of the spring are received such that the spring contacts only the sliders and the fulcrum surface as the sliders move back and forth between their closed and isolated positions.

23. The switch of claim 18, wherein the spring means includes a spring and centering means for centering the spring between the sliders, the centering means comprising curved surfaces facing the sliders, the curved surfaces centering the spring when the first and second sliders are midway between their closed and isolated positions.

24. The switch of claim 18, wherein the jumpers are in a non-linear configuration when the sliders are in their isolated positions and in a linear configuration when the sliders are in their closed positions so as to provide a wiping action on the connector ends when the sliders are moved into and out of their closed positions, the housing including walls configured such that the jumpers lie flat against the walls when the first sliders are in their isolated positions.

* * * * *